US008137809B2

(12) United States Patent
Marissen et al.

(10) Patent No.: US 8,137,809 B2
(45) Date of Patent: Mar. 20, 2012

(54) ULTRA HIGH MOLECULAR WEIGHT POLYETHYLENE MULTIFILAMENT YARNS, AND PROCESS FOR PRODUCING THEREOF

(75) Inventors: Roelof Marissen, Born (NL); Harm van der Werff, Bunde (NL); Joseph Arnold Paul Maria Simmelink, Dilsen-Stokkem (BE); Evert Florentinus Florimondus De Danschutter, Spaubeek (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 12/933,772

(22) PCT Filed: Apr. 9, 2009

(86) PCT No.: PCT/EP2009/002632
§ 371 (c)(1),
(2), (4) Date: Dec. 15, 2010

(87) PCT Pub. No.: WO2009/124762
PCT Pub. Date: Oct. 15, 2009

(65) Prior Publication Data

US 2011/0083415 A1 Apr. 14, 2011

(30) Foreign Application Priority Data

Apr. 11, 2008 (EP) ..... 08007176

(51) Int. Cl.
*D02G 3/00* (2006.01)

(52) U.S. Cl. ..... 428/364; 428/394; 264/103; 264/184; 264/205; 264/210.7; 264/210.8

(58) Field of Classification Search ..... 428/364, 428/394; 264/103, 184, 205, 210.7, 210.8, 264/211.4
See application file for complete search history.

(56) References Cited

U.S. PATENT DOCUMENTS 5,068,073 A * 11/1991 Pennings et al. ..... 264/205
(Continued)

FOREIGN PATENT DOCUMENTS

WO WO 01/88233 11/2001

OTHER PUBLICATIONS

International Search Report for PCT/EP2009/002632, mailed Jun. 4, 2009.

*Primary Examiner* — N. Edwards
(74) *Attorney, Agent, or Firm* — Nixon & Vanderhye P.C.

(57) ABSTRACT

The invention relates to a gel spun, ultrahigh molecular weight polyethylene (UHMWPE) multifilament yarn characterized in that said yarn comprises individual monofilaments having a coefficient of variation of their linear density, hereafter $CV_{intra}$, of less than 30%, wherein the $CV_{intra}$ of a monofilament was determined from linear density values corresponding to a number of 20 representative lengths randomly extracted by cutting from said monofilament and using Formula 1 wherein $\chi_d$ is the linear density of any one of the representative lengths extracted from the monofilament under investigation and Formula 1A is the averaged linear density over the n=20 measured linear densities of said n=20 representative lengths. The invention also relates to a gel spun UHMWPE multifilament yarn characterized in that the yarn has a coefficient of variation in linear density between the monofilaments comprising said yarn, hereafter $CV_{inter}$, of less than 50%. The invention also relates to a gel spinning process of producing thereof characterized in that a chamber is present before the spinning plate such that no further partitioning of the UHMWPE solution takes place before said solution being finally partitioned into individual monofilaments by the spinning plate and in which chamber the solution has a residence time $\tau$ at a constant throughput of UHMWPE solution of at least 5 sec. The invention also relates to a rope, net, medical cable or a composite comprising the yarns of the invention.

9 Claims, 4 Drawing Sheets

U.S. PATENT DOCUMENTS 5,698,324 A 12/1997 Jung et al.
6,723,267 B2 * 4/2004 Simmelink et al. ..... 264/203
6,881,047 B2 * 4/2005 Smith et al. ..... 425/72.2
6,916,533 B2 * 7/2005 Simmelink et al. ..... 428/364
7,364,678 B2 * 4/2008 Smit et al. ..... 264/103
7,618,706 B2 * 11/2009 Simmelink et al. ..... 428/357
7,964,518 B1 * 6/2011 Bhatnagar et al. ..... 442/134
2002/0051880 A1 * 5/2002 Smith et al. ..... 428/364
2007/0154707 A1 * 7/2007 Simmelink et al. ..... 428/364
2007/0231572 A1 10/2007 Tam et al.
2010/0143643 A1 * 6/2010 Simmelink et al. ..... 428/113
2011/0083415 A1 * 4/2011 Marissen et al. ..... 57/255

* cited by examiner

ULTRA HIGH MOLECULAR WEIGHT POLYETHYLENE MULTIFILAMENT YARNS, AND PROCESS FOR PRODUCING THEREOF

This application is the U.S. national phase of International Application No. PCT/EP2009/002632 filed 9 Apr. 2009, which designated the U.S. and claims priority to EP Application No. 08007176.4 filed 11 Apr. 2008, the entire contents of each of which are hereby incorporated by reference.

FIELD

The invention relates to gel spun, ultrahigh molecular weight polyethylene (UHMWPE) multifilament yarns and to a method for producing thereof. Gel spun UHMWPE multifilament yarns are used in various facets of industry and have obtained wide acceptance, for instance for use in articles such as ropes, nets, composites, cut resistant garments, e.g. gloves but also in anti-ballistic products, e.g. bullet-proof vests and helmets. The invention therefore, also relates to such articles comprising said yarns.

BACKGROUND AND SUMMARY

State of the art gel spun UHMWPE multifilament yarns and a process for producing thereof are known from EP 1,699,954. The disclosure thereof relates to UHMWPE yarns having tensile strengths of up to 5.6 GPa and modulus of up to 203 GPa and containing at least 5 filaments.

Although such multifilament yarns have achieved wide acceptance in various fields of industry, there is still a need for further improved yarns and also for an improved process for producing thereof.

It is therefore a first object of the invention to provide novel gel spun UHMWPE multifilament yarns having improved physical and mechanical properties.

It is a second object of the invention to provide a process for producing the novel yarns, wherein the occurrence of disturbances and/or irregularities is reduced. Disturbances are unwanted occurrences that lead to stopping the process as for example filament breakage. Irregularities are unwanted occurrences that require changing the parameters of the process, e.g. spinning and drawing speeds, spinning rate and the like, to prevent alterations in the properties of the final yarn.

Surprisingly, it was found that the first objective was achieved with a novel and improved gel spun UHMWPE multifilament yarn characterized in that said yarn comprises individual monofilaments having a coefficient of variation of their linear density, hereafter $CV_{intra}$, of less than 30%, wherein the $CV_{intra}$ of a monofilament was determined from linear density values corresponding to a number of 20 representative lengths randomly extracted by cutting from said monofilament and using Formula 1

$$CV_{INTRA} = \sqrt{\frac{\sum_{i=1}^{n}(x_i - \bar{x})^2}{n-1}} \times \frac{1}{\bar{x}} \times 100 \qquad \text{Formula 1}$$

wherein $x_i$ is the linear density of any one of the representative lengths extracted from the monofilament under investigation and $\bar{x}$ is the averaged linear density over the n=20 measured linear densities of said n=20 representative lengths.

The advantage of the yarn of the invention is that it is more homogeneous, i.e. the monofilaments of said yarn show less differentiation from one another in their mechanical and physical properties. The yarn of the invention has also improved mechanical and physical properties. Moreover, it was surprisingly found that the yarn of the invention shows improved handling, especially at elevated speeds as for example in coating processes or in processes including yarn winding and/or high speed yarn transportation. Examples of such processes wherein the yarn of the invention is successfully used include weaving, braiding and processes for the production of ropes, cables and nets, in particular knotless nets. Therefore, the invention also relates to the use of the yarn of the invention in processes including yarn winding and/or high speed yarn transportation.

Yet a further advantage of the yarn of the invention is that products comprising said yarn show improved mechanical properties. For example, a rope comprising said yarn shows improved fatigue and/or lifetime when subjected to for example cyclic loads. Another example is that of a medical cable and more in particular that of a suture comprising the yarn of the invention, said medical cable or suture showing for instance improved knot strength.

By mechanical properties of a yarn is herein understood those properties that are associated with an elastic or inelastic reaction of said yarn when a force is applied thereon. Examples of mechanical properties construed in the light of the present invention are tensile strength, elastic modulus, breaking force, elongation at break and the like. By physical properties is herein understood those properties characteristic to a yarn that can be observed or measured without changing the composition or identity of the yarn. Examples of physical properties construed in the light of the present invention are the linear density or the diameter of individual monofilaments, the titre of the yarn and the like.

For the purposes of the present invention, an individual monofilament is an elongated body the length dimension of which is much greater than its transverse diameter. Preferably, the monofilaments have a substantially circular or elliptical cross-section. By multifilament yarn is herein understood an elongated body comprising a plurality of individual monofilaments. The yarn of the invention may contain substantially parallel monofilaments or it may be twisted or braided.

Preferably, the $CV_{intra}$ of the inventive yarn is less than 25%, more preferably less than 20%, even more preferably less than 15%, yet even more preferably less than 10%, most preferably less than 5%. Multifilament UHMWPE yarns with such reduced $CV_{intra}$ values are for example obtained with the process of the invention as explained below.

Surprisingly, the forenamed advantages of the invention were also achieved according to a second embodiment of the invention with a novel gel spun UHMWPE multifilament yarn having a coefficient of variation in linear density between the monofilaments comprising said yarn, hereafter $CV_{inter}$, of less than 50%, wherein $CV_{inter}$ is determined by using linear density values of a number of 50 representative lengths, wherein each of said lengths corresponds to a different randomly chosen monofilament and is extracted by cutting thereof and using Formula 2

$$CV_{INTER} = \sqrt{\frac{\sum_{i=1}^{n}(x_i - \bar{x})^2}{n-1}} \times \frac{1}{\bar{x}} \times 100 \qquad \text{Formula 2}$$

wherein $x_i$ is the linear density of any one of said representative lengths and $\bar{x}$ is the averaged linear density over the n=50 measured linear densities of the n=50 representative lengths corresponding to the randomly chosen monofilaments.

A surprising advantage of such a yarn is that for a determined tensile strength, said yarn has a reduced thickness compared with known yarns of the same strength. Without being bound to any explanation, the inventors attributed the reduction in thickness to a better packing of the individual monofilaments within the yarn.

Preferably, $CV_{inter}$ is less than 40%, more preferably less than 30%, even more preferably less than 20%, yet even more preferably less than 10%, most preferably less than 5%. Multifilament UHMWPE yarns with such reduced $CV_{inter}$ values are obtained for example with the process of the invention as explained below.

In a preferred embodiment of the invention the inventive yarns have both a $CV_{intra}$ and $CV_{inter}$ within the ranges defined above. Such yarns have further improved mechanical and/or physical properties.

Preferably, the modulus of the inventive yarns is at least 50 GPa, more preferably at least 100 GPa, even more preferably at least 150 GPa, most preferably at least 180 GPa.

Preferably, the strength of the inventive yarns is at least 1.2 GPa, more preferably at least 2 GPa, even more preferably at least 3 GPa, yet even more preferably at least 4 GPa, yet even more preferably at least 5 GPa, most preferably at least 5.5 GPa. The inventors were surprised that the inventive yarns have such high tensile strengths as it is known in the art that an increase in tensile properties is achieved at the expense of other physical properties, e.g. variations in their linear density. It was therefore, surprisingly found that the inventive yarns posses a combination high tensile strength and low $CV_{inter}$ and/or $CV_{intra}$ never achieved hitherto.

Preferably, the elongation at break of the inventive yarns is at most 5%, more preferably at most 3.5%, most preferably at most 2.5% and preferably at least 0.5%, more preferably at least 0.75%.

Preferably the titer of the individual monofilaments of the inventive yarns is at least 0.8 dpf, more preferably at least 1, most preferably at least 1.5 dpf. Preferably, said titer is at most 30 dpf, more preferably at most 20 dpf, most preferably at most 10 dpf. It is known in the art that the nonhomogeneity problems increase with decreasing the titer of the monofilaments. However, it was surprisingly found that the homogeneity of individual monofilaments expressed in terms of $CV_{intra}$ and the homogeneity of the yarn expressed in terms of $CV_{inter}$ are substantially preserved with decreasing the titer thereof.

By inventive yarns is hereinbefore and hereinafter understood the gel spun UHMWPE yarns of the invention. By representative lengths is understood lengths of monofilament randomly extracted by cutting either from the same monofilament under investigation when $CV_{intra}$ is to be determined, either each being extracted from a different monofilament of the yarn when $CV_{inter}$ is to be determined.

The invention also relates to articles comprising the novel and inventive gel spun UHMWPE multifilament yarns of the invention. It was found that ropes and nets comprising the yarns of the invention show improved properties and are easier to be manufactured from the yarns of the invention. Therefore, the invention relates in particular to a rope and a net comprising the inventive yarns. Ropes may be heavy-duty ropes, including ropes for application in marine and offshore operations, like anchor handling, seismic operations, mooring of drilling rigs and production platforms, and towing. The high tenacity and the high resistance of the yarn to wear give the rope an excellent load bearing performance. The rope is easy to handle because of its light-weight. The net may be a fishing net. High bite-resistance and light-weight of the yarn makes it especially useful as a fishing net.

The invention also relates to medical devices comprising the yarns of the invention. In a preferred embodiment, the medical device is a cable or a suture. Other examples include mesh, endless loop products, bag-like, balloon-like products and other woven and/or knitted products. Good examples of cables include a trauma fixation cable, a sternum closure cable, and a prophylactic or per prosthetic cable, long bone fracture fixation cable, small bone fracture fixation cable. Also tube-like products for e.g. ligament replacement are possible.

Composite articles comprising the yarns of the invention also show improved properties. Therefore, the invention relates in particular to a composite article comprising the yarns in accordance with the embodiments of the invention. Preferably, the composite articles comprise networks of the inventive yarns. By network is meant that the monofilaments of said yarns are arranged in configurations of various types, e.g. a knitted or woven fabric, a non-woven fabric with a random or ordered orientation of the yarns, a parallel array arrangement also known as unidirectional UD arrangement, layered or formed into a fabric by any of a variety of conventional techniques. Preferably, said articles comprise at least one network of said yarns. More preferably, said articles comprise a plurality of networks of the inventive yarns, preferably UD networks and preferably the direction of the yarns in one layer being at an angle to the direction of the yarns in adjacent layers. Such networks of the inventive yarns can be comprised in cut resistant garments, e.g. gloves and also in anti-ballistic products, e.g. bullet-proof vests and helmets. Therefore, the invention also relates to the articles enumerated hereinabove comprising the yarns of the invention.

The invention also relates to a roundsling comprising the yarn of the invention. Since roundslings need to be able to withstand forces in severe conditions, often for a long time, the high strength of the yarn is advantageous.

The invention also relates to sports equipments comprising the yarn of the invention, including a fishing line, a kite line and a yacht line. The low elongation and high modulus of the yarn are advantageous for a fishing line, because it allows a fisherman to feel even an initial bite of a fish on a lure. These properties also allow precise control in kiting and yachting.

The invention also relates to an air cargo net and an air freight container comprising the yarn of the invention. The high strength, abrasion resistance and lightweight of the yarn make it especially suitable in an aircraft application.

The invention further relates to a gel spinning process of producing the novel and inventive UHMWPE multifilament yarns. The process according to the invention comprises the steps of:

a) feeding to an extruder a slurry containing an UHMWPE in a spinning solvent;
b) converting the slurry in the extruder into a solution of UHMWPE in the spinning solvent;
c) spinning a multifilament yarn by passing the solution of step b) through a spinning plate containing a plurality of spin holes to form the monofilaments comprising said yarn;
d) cooling the obtained monofilaments to form gel monofilaments;
e) removing at least partly the spinning solvent from the gel monofilaments; and
f) drawing the monofilaments in at least one drawing step before, during or after removing the spin solvent;

characterised in that a chamber is present before the spinning plate such that no further partitioning of the UHMWPE solution obtained at step b) takes place before said solution being finally partitioned into individual monofilaments in step c) and in which chamber the solution has a residence time $\tau$ at a constant throughput of UHMWPE solution of at least 50 sec.

By partitioning of the UHMWPE solution is herein meant dividing the volume of said solution into a plurality of smaller volumes for example by the teeth of moving components in an extruder, gear pump, positive displacement pump and the like or by passing the solution through a filtering sieve, through multiple conduits at the same time, and the like.

By residence time $\tau$ is herein understood the average time (in seconds) spent by a volume unit of the UHMWPE solution within the chamber before exiting it. The residence time is defined as the ratio between the volume V of the chamber and the volumetric flow rate $\nu$ according to Formula 3:

$$\tau = \frac{V}{\nu} \qquad \text{Formula 3}$$

The volumetric flow rate $\nu$ is the volume of UHMWPE solution exiting the nozzle of the extruder, i.e. the output of the extruder, perpendicularly flowing through the cross-section of the chamber per unit time.

It has been surprisingly found that the process of the invention produces new and improved UHMWPE multifilament yarns and is less adversely affected by disturbances and/or irregularities as compared with known processes. It was found that disturbances and/or irregularities were present in the production process to a lesser extent making the process more economical. It was also found that the number of events wherein the total breakage of the yarns occurred was reduced also. Surprisingly, the yarns of the invention were produced with an improved throughput than the known gel spun UHMWPE multifilament yarns.

Also an improved yield at the same production velocity was surprisingly observed. The process of the invention thus produces a yarn characterized by a low $CV_{inter}$ and/or $CV_{intra}$ even when using a large number of spin holes and furthermore it operates much more economically than other, comparable processes.

A process comprising the steps a)-f) is known from EP 1,699,954. However, the disclosure thereof does not mention a chamber wherein the UHMWPE solution resides for a time $\tau$.

WO 2007/118008 A2 discloses the use of a chamber to introduce a residence time in a gel spinning process for UHMWPE. However, the process disclosed therein uses the residence time to allow for a longer dissolution time of the particles of the UHMWPE powder in the spinning solvent. Said process does not use the residence time to allow for a longer relaxation time of the UHMWPE solution obtained after the dissolution of said particles in said solvent and/or after the extrusion step, as the process of the invention allows by using a chamber as specified in the paragraphs above. Furthermore, in the process of the cited reference, after making the UHMWPE solution, said solution is passed through a positive displacement pump wherein partitioning of the solution takes place. Therefore, the advantageous effects of the process of the invention cannot be achieved by the process disclosed in the cited reference. Hereafter the figures are explained.

DETAILED DESCRIPTION

The chamber used in the process of the invention may have any shape provided that its internal volume is sufficient to provide the required residence time $\tau$. However, it is preferred that the residence time distribution is as narrow as possible. Narrowing down $\tau$ can be obtained for example by decreasing the volume of the chamber.

Figure 1:
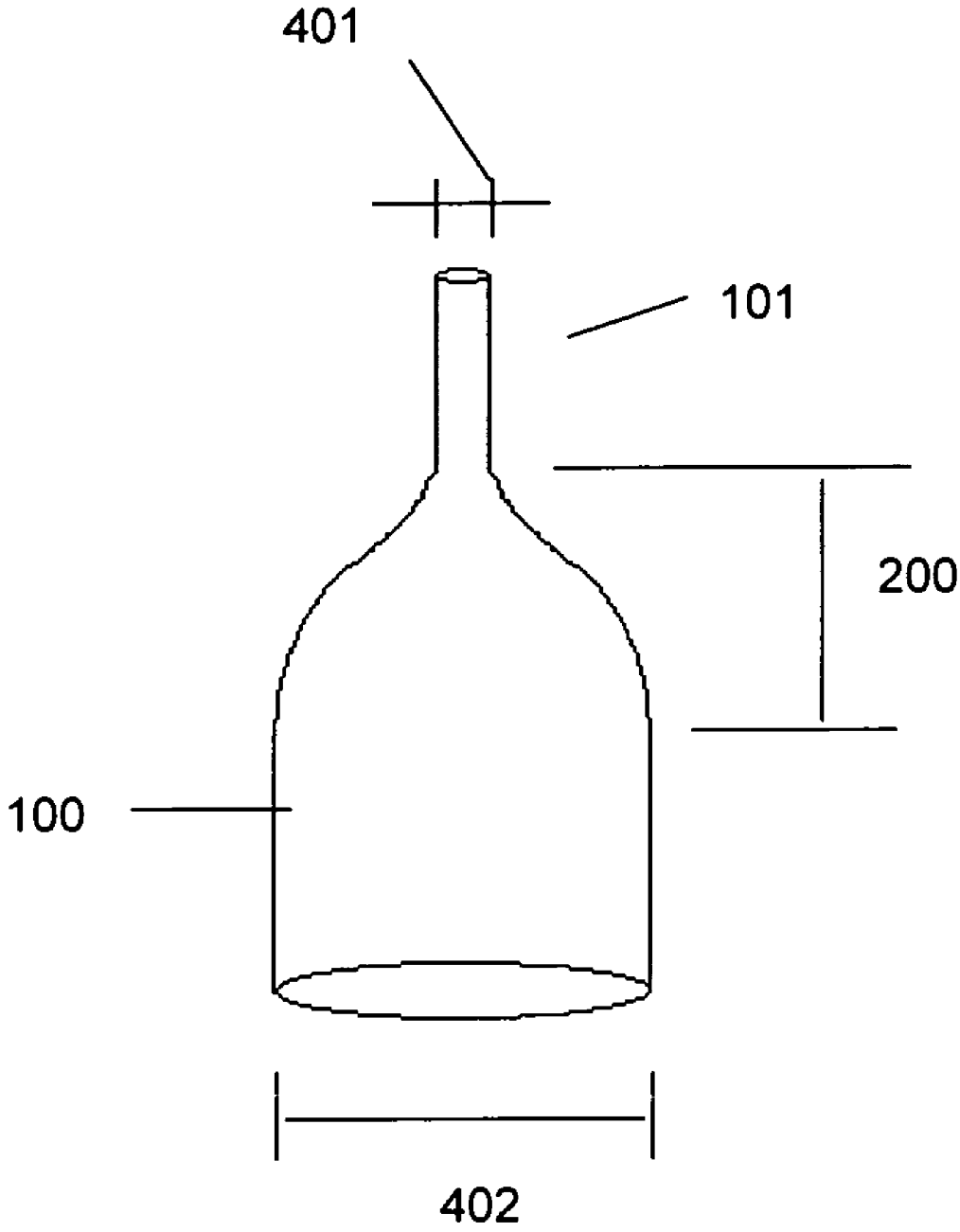
FIG. 1 shows a gradual connection between the chamber and the conducting means.

Examples of chamber embodiments are vessels or pipes, e.g. straight or bended pipes. Vessels and in particular vessels with a round cross section, e.g. cylindrical vessels, are preferred. It is also preferred that the connection of the chamber to the conducting means used for transporting the UHMWPE solution to the chamber is a gradual connection (FIG. 1). By gradual connection is herein meant a gradual decrease over a length l (200) in the diameter $\Phi_1$ (402) of the chamber (100) until said diameter becomes equal with the diameter $\Phi_2$ (401) of the conducting means (101). Preferably, l is between 5 and 150 mm, more preferably between 10 and 50 mm.

Figure 2:
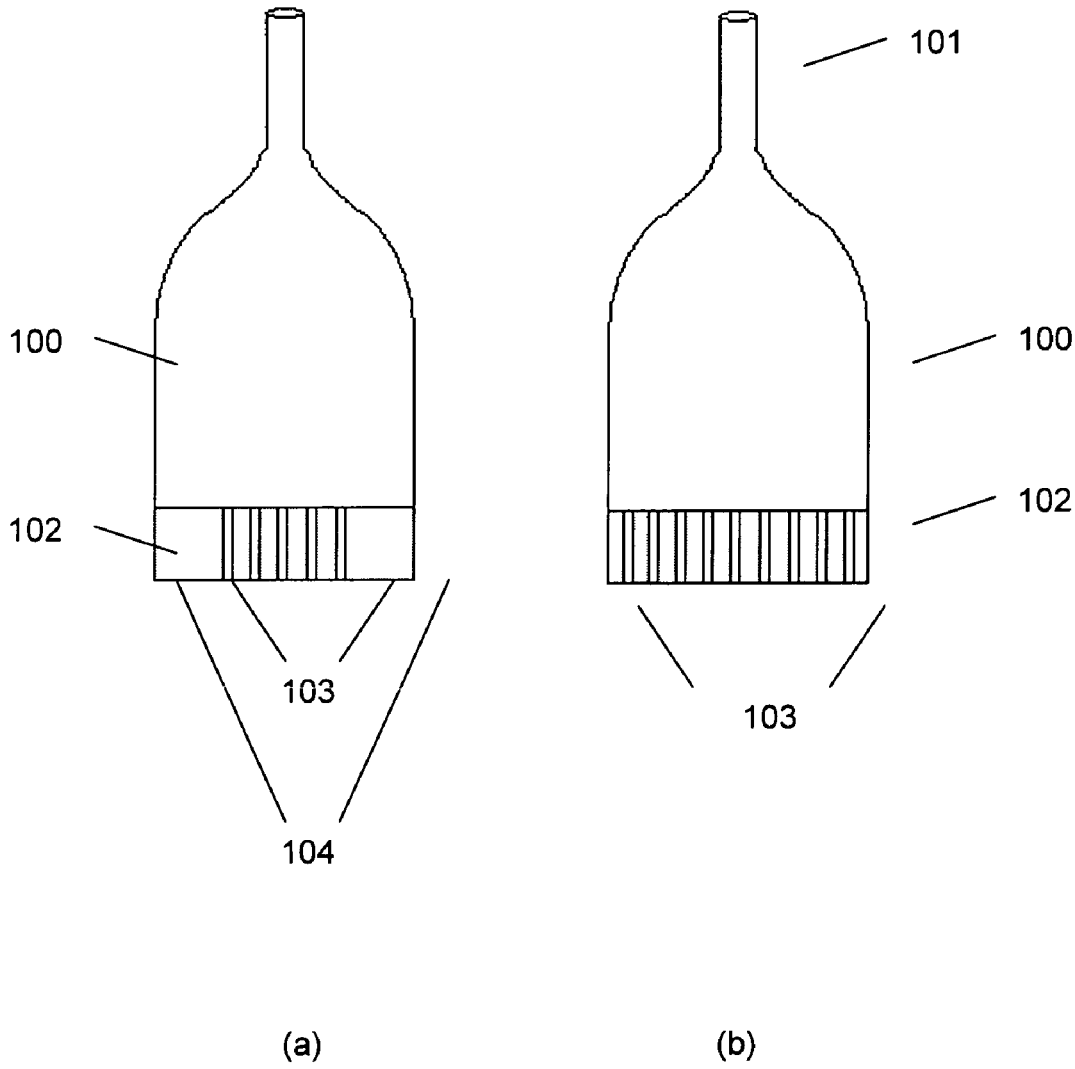
FIGS. 2 and 3 depict different constructions of the chamber.

In a preferred embodiment, the spin plate is connected directly to the chamber without the use of any conducting means in-between, as shown in FIG. 2, such that after the solution resided in the chamber for the desired $\tau$ it is immediately spun into individual fluid monofilaments. With reference to FIG. 2*a*), the chamber (100) is directly connected to the spin plate (102) without any conducting means in between. The area (103) on the spin plate containing the spin holes is smaller than the area of the entire spin plate (104). Preferably, the cross-section of the chamber (100) has the same or about the same shape and size as the spinning plate (102), more preferably said cross-section has the same or about the same shape and size as the cross-section of the area (103) on the spinning plate wherein the spinning holes are located. As shown in FIG. 2*b*) the area (103) is equal or about equal with the area of the spin plate (104). In a preferred embodiment, all cross sections are round. It was found that with this embodiment of the process of the invention, $CV_{inter}$ and $CV_{intra}$ are further improved.

Figure 3:
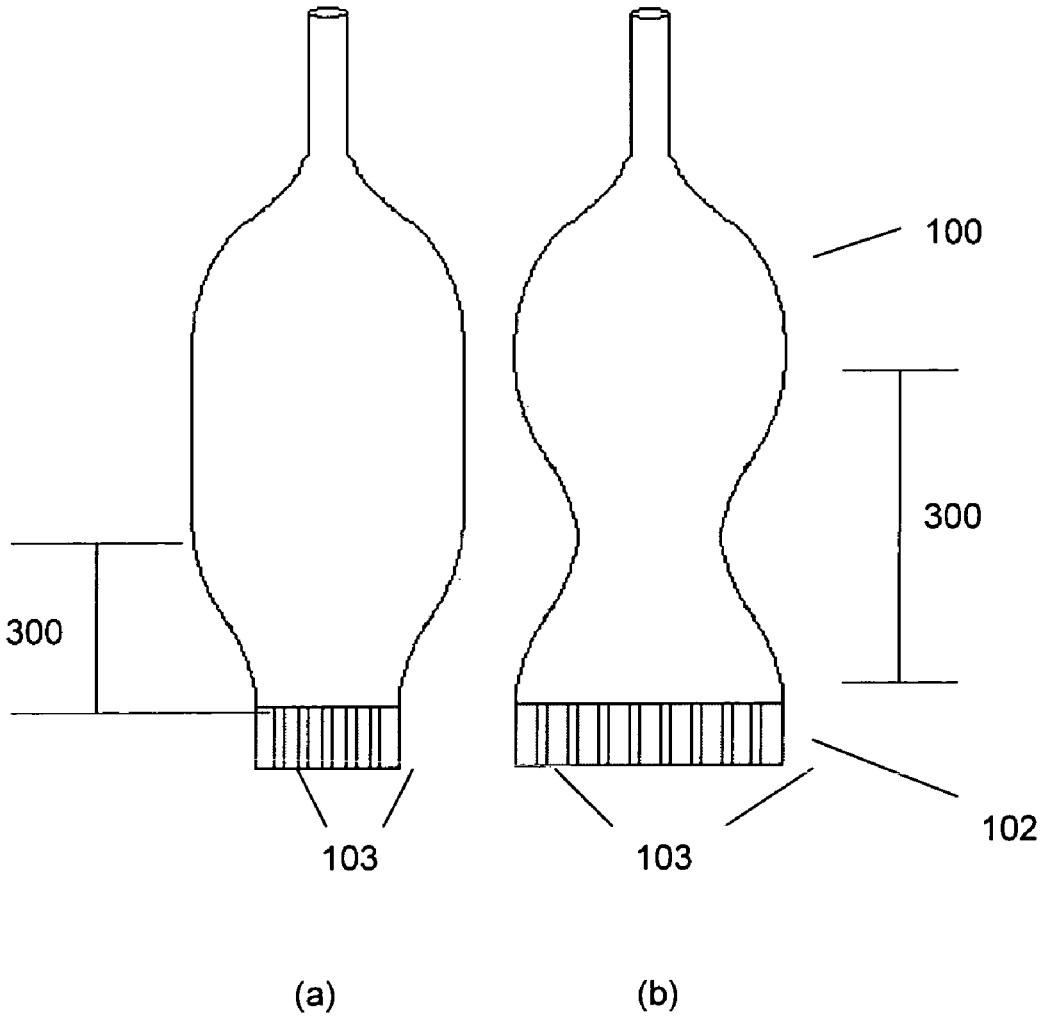

In a more preferred embodiment as depicted in FIG. 3 and more in particular in FIG. 3*a*), the initial cross section of the chamber (100) is larger than that of the spin plate (102) and the chamber presents a strangulation (300) over a length £, i.e. the initial cross section of the chamber (100) is gradually reduced along the axial length of the chamber to the cross-section of the spin plate (102). FIG. 3*b*) shows a more preferred embodiment of the chamber used in the process of the invention. Therein, the initial cross section of the chamber (100) is gradually reduced and increased again over a length (300) from a cross section that is smaller than that of the spin plate (102), even more preferably smaller than that of the area (103) on the spin plate containing the spin holes, to a cross section that is about the same with the cross section (102) of the spin plate or of the area (103) on the spin plate containing the spin holes. It was found that with this embodiment of the inventive process, $CV_{inter}$ and $CV_{intra}$ are mostly improved.

Normally, a sieve pack is present between the spinning plate and the screw tip of the extruder to filter the UHMWPE solution. In case that a sieve pack is used, the chamber is present between the spinning plate and the sieve pack. The solution is fed preferably with metering pumps, preferably at a constant volumetric flow rate, to various hardware components, e.g. chamber, extruder, and the like.

According to the process of the invention, a chamber is present before the spinning plate in which chamber the UHMWPE solution has a residence time $\tau$ at a constant throughput of UHMWPE solution of preferably at least 60 sec. More preferably, $\tau$ is at least 120 sec, even more preferably at least 180 sec, yet even more preferably at least 200 sec, yet even more preferably at least 240 sec, yet even more preferably at least 300 sec, yet even more preferably at least 360 sec, most preferably at least 720 sec. The residence time $\tau$ in the chamber at a constant throughput of solution may be increased by increasing the diameter of the cross-section and/or the length of the chamber. It was observed that by increasing $\tau$, the $CV_{inter}$ and $CV_{intra}$ decrease.

Preferably, $\tau$ is at most 1800 sec, more preferably at most 1200 sec, most preferably at most 800 sec. Increasing further $\tau$ would lead to further improved UHMWPE yarns in terms of lower coefficients of variation as defined hereinabove. However, the productivity of the inventive process would decrease to an uneconomical level and thermal degradation of the polymer might occur.

Preferably, the average shear rate to which the UHMWPE solution is subjected inside the chamber is at least $10^{-9}$ $sec^{-1}$, more preferably at least $10^{-6}$ $sec^{-1}$, even more preferably at least $10^{-4}$ $sec^{-1}$, most preferably at least $10^{-2}$ $sec^{-1}$. Preferably, said average shear rate is at most 10 $sec^{-1}$, more preferably at most 5 $sec^{-1}$, even more preferably at most 2 $sec^{-1}$, most preferably at most 1 $sec^{-1}$. This gives further reduced CV's. At a constant throughput of solution, the shear rate in the chamber may be varied by modifying the diameter of the cross-section of the chamber. By shear rate [in $sec^{-1}$] is herein understood the ratio between the velocity [in $cm \cdot sec^{-1}$] of the UHMWPE solution inside the chamber and the clearance, e.g. diameter, of the chamber [in cm].

Preferably the chamber is heated to a temperature of between 120 and 220° C., more preferably between 160 and 190° C. Preferably, the temperature of the chamber is about the temperature of the UHMWPE solution. The heating may be provided by external jacketing and circulation of heat transfer fluid, or the chamber may be electrically heated by contact with resistive elements, or the chamber may be heated by induction coupling to a power source. It is preferred that the heating be done by external circulation of a heat transfer fluid.

The UHMWPE used in the process of the invention preferably has an intrinsic viscosity (IV), as measured on solution in decalin at 135° C. of at least 5 dl/g, preferably at least 10 dl/g, more preferably at least 15 dl/g, most preferably at least 21 dl/g. Preferably, the IV is at most 40 dl/g, more preferably at most 30 dl/g, even more preferably at most 25 dl/g. A careful selection of the IV provides a balance between the processability of the UHMWPE solution that is to be spun and the mechanical properties of the obtained monofilaments.

Preferably, the UHMWPE is a linear polyethylene with less than one branch per 100 carbon atoms, and preferably less than one branch per 300 carbon atoms; a branch or side chain or chain branch usually containing at least 10 carbon atoms. The linear polyethylene may further contain up to 5 mol % of one or more comonomers, such as alkenes like propylene, butene, pentene, 4-methylpentene or octane but also small amounts, generally less than 5 mass %, preferably less than 3 mass % of customary additives, e.g. anti-oxidants, thermal stabilizers, colorants, flow promoters, etc.

To prepare the UHMWPE slurry of step a) of the process of the invention, the UHMWPE preferably in the form of pellets and more preferably as a powder may be mixed with any of the known spinning solvents, i.e. solvents suitable for gel spinning UHMWPE. The formation of the UHMWPE slurry may be done in an agitated mixing tank and the slurry so formed discharged to the extruder or it may be directly produced in the extruder.

Preferably, the UHMWPE slurry contains at least 3 mass %, more preferably of at least 5 mass %, even more preferably at least 8 mass %, most preferably at least 10 mass % of UHMWPE. The UHMWPE slurry, preferably contains at most 30 mass %, more preferably at most 25 mass %, even more preferably at most 20 mass %, most preferably at most 15 mass % of UHMWPE. To improve processability, a lower concentration is preferred the higher the molar mass of the polyethylene is. Preferably, the slurry contains between 3 and 25 mass % UHMWPE for an UHMWPE with IV in the range 15-25 dl/g. However, to obtain the homogeneous inventive yarns, a slurry with a higher concentration is preferably used. Therefore, more preferably, the slurry contains between 5 and 20 mass % UHMWPE for an UHMWPE with IV in the range 15-25 dl/g.

Suitable examples of spinning solvents include aliphatic and alicyclic hydrocarbons, e.g. octane, nonane, decane and paraffins, including isomers thereof; petroleum fractions; mineral oil; kerosene; aromatic hydrocarbons, e.g. toluene, xylene, and naphthalene, including hydrogenated derivatives thereof, e.g. decalin and tetralin; halogenated hydrocarbons, e.g. monochlorobenzene; and cycloalkanes or cycloalkenes, e.g. careen, fluorine, camphene, menthane, dipentene, naphthalene, acenaphtalene, methylcyclopentandien, tricyclodecane, 1,2,4,5-tetramethyl-1,4-cyclohexadiene, fluorenone, naphtindane, tetramethyl-p-benzodiquinone, ethylfuorene, fluoranthene and naphthenone. Also combinations of the above-enumerated spinning solvents may be used for gel spinning of UHMWPE, the combination of solvents being also referred to for simplicity as spinning solvent. In a preferred embodiment, the spinning solvent of choice is not volatile at room temperature, e.g. paraffin oil. It was also found that the process of the invention is especially advantageous for relatively volatile spinning solvents at room temperature, as for example decalin, tetralin and kerosene grades. In the most preferred embodiment the spinning solvent of choice is decalin.

According to the invention, the UHMWPE solution is formed into individual monofilaments by spinning said solution through a spinning plate containing a plurality of spinholes.

In a preferred embodiment of the invention, it was surprisingly found that further improved $CV_{intra}$ and $CV_{inter}$ for the yarns of the invention may be obtained if a spinning plate is used having at most 20 spin holes per $cm^2$, preferably at most 15, most preferably of at most 10 spin holes per $cm^2$. The invention therefore also relates to such spinning plate and to its use in a polymeric fibre spinning process. Preferably, said spinning plate has at least 0.5 spin holes per $cm^2$, more preferably at least 1, most preferably of at least 3 spin holes per $cm^2$. Preferably, the spin holes of the spin plate are distributed over the entire surface of the spin plate, more preferably they are evenly distributed. It was found that the use of such spinning plate not only produces more uniform UHMWPE multifilament yarns but also reduces the occurrence of breakages of the individual monofilaments, improving the productivity of the process.

Preferably, the spinning plate contains at least 10 spinholes, more preferably at least 50, even more preferably at least 100, yet even more preferably at least 300, most preferably at least 500. Preferably the spinning plate contains at most 5000, more preferably at most 3000, most preferably at most 1000 spinholes.

The monofilaments, as issued from the spinning plate are fluid monofilaments. As used herein, the term "fluid monofilament" refers to a fluid-like monofilament containing a solution of UHMWPE in the spinning solvent used to prepare said UHMWPE solution, said fluid monofilament being obtained by extruding the UHMWPE solution through the spinning plate, the concentration of the UHMWPE in the extruded fluid monofilaments being the same or about the same with the concentration of the UHMWPE solution before said extrusion.

Preferably, the spinning temperature is between 150° C. and 250° C., more preferably it is chosen below the boiling point of the spinning solvent. If for example decaline is used as spinning solvent the spinning temperature is preferably at most
190° C., more preferably at most 180° C., most preferably at most 170° C. and preferably at least 115° C., more preferably at least 120° C., most preferably at least 125° C. In case of paraffin, the spinning temperature is preferably below 220° C., more preferably between 130° C. and 195° C.

In a preferred embodiment, each spinhole of the spinneret has a geometry comprising at least one contraction zone. By contraction zone is herein understood a zone with a gradual decrease in diameter with a cone angle of between 10° and 20°, more preferably between 13° and 17°, from a diameter $D_0$ to $D_n$ such that a draw ratio $DR_{sp}$ is achieved in the spinhole. Preferably, the spinhole further comprises downstream of the contraction zone, a zone of constant diameter with a length/diameter ratio $L_n/D_n$ of between 1 and 50. It was observed that for longer $L_n/D_n$ the CV's of the inventive yarns were further reduced. Therefore, the $L_n/D_n$ is more preferably between 3 and 25 most preferably between 5 and 15.

The draw ratio in the spinholes $DR_{sp}$ is represented by the ratio of the solution flow speed at the initial cross-section and at the final cross-section of the contraction zone, which is equivalent to the ratio of the respective cross-sectional areas. In case of contraction zone having the shape of a frustum of a circular cone, $DR_{sp}$ is equal to the ratio between the square of the initial and final diameters, i.e.$=(D_0/D_n)^2$. Preferably, $D_0$ and $D_n$ are chosen to yield a $DR_{sp}$ of at least 5, more preferably at least 10, even more preferably at least 15, most preferably at least 20.

The fluid monofilaments are preferably issued into an air gap with a length of preferably between 1 and 200 mm, more preferably between 10 and 100 mm, most preferably between 20 and 75 mm, and then into a cooling zone from where they are picked-up on a first driven roller. Preferably, the fluid monofilaments are stretched in the air gap with a drawing ratio $DR_{ag}$ of at least 5, more preferably at least 20, most preferably at least 40. Stretching in the air gap is achieved by choosing an angular speed of the first driven roller such that said roller's surface velocity exceeds the issuing speed of the fluid monofilaments, i.e. the flow rate of the UHMWPE solution issued form the spinneret.

Preferably, the $DR_{sp}$ and $DR_{ag}$ are chosen in the process of the invention to yield a total draw ratio of the fluid monofilaments, $DR_{fluid}=DR_{sp}\times DR_{ag}$ of at least 100, more preferably at least 200, most preferably at least 300.

Cooling, also known as quenching, the fluid monofilaments after exiting the air-gap to form solvent-containing gel monofilaments, may be performed in a gas flow and/or in a liquid cooling bath. Preferably, the cooling bath contains a cooling liquid that is a non-solvent for ‡UHMWPE and more preferably a cooling liquid that is not miscible with the solvent used for preparing the UHMWPE solution. Preferably, the cooling liquid flows substantially perpendicular to the filaments at least at the location where the fluid filaments enter the cooling bath, the advantage thereof being that the drawing conditions can be better defined and controlled. This is advantageous when aiming to obtain yarns with reduced coefficients of variation as presented hereinabove.

By air-gap is meant the length travelled by the fluid monofilaments before they are converted into solvent-containing gel monofilaments if gas cooling is applied or the distance between the face of the spinneret and the surface of the cooling liquid in the liquid cooling bath. Although called air-gap, the atmosphere can be different than air; e.g. as a result of a flow of an inert gas like nitrogen or argon, or as a result of solvent evaporating from monofilaments or a combination thereof.

As used herein, the term "gel monofilament" refers to a monofilament which upon cooling develops a continuous UHMWPE network swollen with the spinning solvent. An indication of the conversion of the fluid monofilament into the gel monofilament and the formation of the continuous UHMWPE network may be the change in monofilament's transparency upon cooling from a translucent monofilament to a substantially opaque monofilament, i.e. the gel monofilament.

Preferably, the temperature to which the fluid monofilaments are cooled is at most 100° C., more preferably at most 80° C., most preferably at most 60° C. Preferably, the temperature to which the fluid monofilaments are cooled is at least 1° C., more preferably at least 5° C., even more preferably at least 10° C., most preferably at least 15° C.

In a preferred embodiment the solvent-containing gel monofilaments are drawn in at least one drawing step with a draw ratio $DR_{gel}$ of at least 1.05, more preferably at least 1.5, even more preferably at least 3, yet even more preferably at least 6, most preferably at least 10. The drawing temperature of the gel monofilaments is preferably between 10° C. and 140° C., more preferably between 30° C. and 130° C., even more preferably between 50° C. and 130° C., yet even more preferably between 80° C. and 130° C., most preferably between 100° C. and 120° C.

Subsequently to forming the gel monofilaments, said gel monofilaments are subjected to a solvent removal step wherein the spinning solvent is at least partly removed from the gel monofilaments to form solid monofilaments. The amount of residual spinning solvent, hereafter residual solvent, left in the solid monofilaments after the extraction step may vary within large limits, preferably the residual solvent being in a mass percent of at most 15% of the initial amount of solvent in the UHMWPE solution, more preferably in a mass percent of at most 10%, most preferably in a mass percent of at most 5%.

The solvent removal process may be performed by known methods, for example by evaporation when a relatively volatile spinning solvent, e.g. decaline, is used to prepare the UHMWPE solution or by using an extraction liquid, e.g. when paraffin is used, or by a combination of both methods. Suitable extraction liquids are liquids that do not cause significant changes to the UHMWPE network structure of the UHMWPE gel fibres, for example ethanol, ether, acetone, cyclohexanone, 2-methylpentanone, n-hexane, dichloromethane, trichlorotrifluoroethane, diethyl ether and dioxane or mixtures thereof. Preferably, the extraction liquid is chosen such that the spinning solvent can be separated from the extraction liquid for recycling.

The process according to the invention further comprises drawing the monofilaments before, during and/or after said removal of the solvent. Preferably, the drawing of the monofilaments is performed in at least one drawing step with a draw ratio $DR_{solid}$ of preferably at least 4. More preferably, $DR_{solid}$ is at least 7, even more preferably at least 10, yet even more preferably at least 15, yet even more preferably at least 20, yet even more preferably at least 30, most preferably at least 40. More preferably, the drawing of monofilaments is performed in at least two steps, even more preferably in at least three steps. Preferably, each drawing step is carried out at a different temperature that is preferably chosen to achieve the desired drawing ratio without the occurrence of monofilament breakage. If the drawing of solid filaments is performed in more than one step, $DR_{solid}$ is calculated by multiplying the draw ratios achieved for each solid individual drawing step.

Preferably, the overall draw ratio, $DR_{overall}=DR_{fluid}\times DR_{gel}\times DR_{solid}$ is at least 5.000, more preferably at least 10.000, most preferably at least 15.000. It was observed that by increasing the overall draw ratio, the mechanical properties of the yarns of the invention were improved. In particular the tensile strength and modulus increased. By increasing the $DR_{overall}$, also the titer of the yarns' filaments decreases.

The invention will be further explained by the following examples and comparative experiment.

Methods:

IV: the Intrinsic Viscosity is determined according to method PTC-179 (Hercules Inc. Rev. Apr. 29, 1982) at 135° C. in decalin, the dissolution time being 16 hours, with DBPC as anti-oxidant in an amount of 2 g/l solution, by extrapolating the viscosity as measured at different concentrations to zero concentration;

Dtex: fibers' titer (dtex) was measured by weighing 100 meters of fiber. The dtex of the fiber was calculated by dividing the weight in milligrams by 10;

Tensile properties: tensile strength and tensile modulus are defined and determined on multifilament yarns as specified in ASTM D885M, using a nominal gauge length of the fibre of 500 mm, a crosshead speed of 50%/min and Instron 2714 clamps, of type "Fibre Grip D5618C". On the basis of the measured stress-strain curve the modulus is determined as the gradient between 0.3 and 1% strain. For calculation of the modulus and strength, the tensile forces measured are divided by the titre, as determined by weighing 10 meters of fibre; values in GPa are calculated assuming a density of 0.97 g/cm$^3$.

Linear density: Determination of the linear density of monofilaments was carried out on a semiautomatic, microprocessor controlled tensile tester (the Favimat, tester no. 37074, from Textechno Herbert Stein GmbH & Co. KG, Monchengladbach, Germany). The Favimat tester works according to the principle of constant rate of extension (ISO 5079) with integrated measuring head for linear density measurements. The linear density measurements were carried out according to the vibroscopic testing principle of ASTM D1577 using constant tensile force and gauge length and variable exciting frequency (ISO 1973). The Favimat tester was equipped with a 1200 cN balance, no. 14408989. The version number of the Favimat software was 3.2.0.

Figure 4:
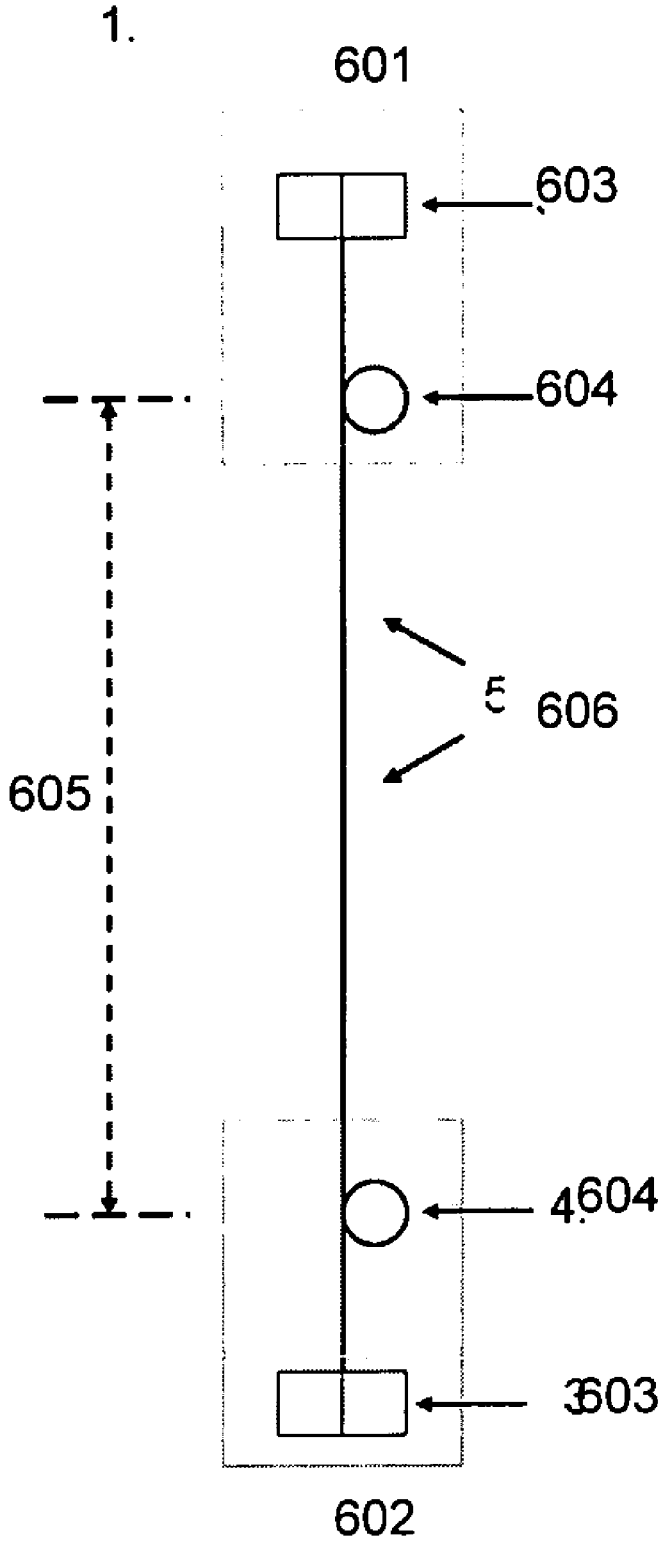
FIG. 4 shows schematically the device used for measuring the linear density of the yarns of the invention.

Clamp slippage during monofilament testing is eliminated by adaption of the clamps of the Favimat tester according to FIG. 4. The upper clamp (601) is attached to the load cell (not shown). The lower clamp (602) is the clamp that moves downwards in order to apply a desired load on the monofilament.

A representative length of the monofilament (606) to be tested was cut from said monofilament with a sharp blade, winded three times over ceramic pins (604) and finally clamped at each of the two clamps between two (4×4×2 mm) jaw faces (603) manufactured from Plexiglas®. The length was enough to ensure a good mounting of the monofilament and was about 200 mm.

The linear density of the monofilament length (605) between the ceramic pins is determined vibroscopically as described above by following the routines implemented in the tester's software and described in the tester's manual. The distance between the pins during measurements is kept at 50 mm, the monofilament being tensioned at 2.50 cN/tex.

EXAMPLE 1

A 7.4 mass % slurry of a UHMWPE homopolymer powder having an IV of 23.4 dl/g was prepared and fed to a 25 mm co-rotating twin screw extruder heated at a temperature of 180° C., the extruder also being equipped with a gear-pump. In the extruder the slurry was transformed into a solution and the solution was issued through a spin plate having 64 spin holes evenly distributed in a square pattern, into a nitrogen atmosphere with a rate of 1.0 g/min per hole. The area of the spin plate was about 50 cm$^2$ and the spin holes were evenly distributed thereon. The spin plate was connected directly to a chamber having a volume of 350 cm$^3$ as in FIG. 2*a*). The chamber was thermally insulated to avoid the cooling of the solution inside the chamber. The residence time of the UHMWPE solution in the chamber was 262.5 sec.

The spin holes had an initial cylindrical channel of 2.0 mm diameter ($D_i$) and length ($L_i$) over diameter ratio ($L_i/D_i$) of 18, followed by a conical contraction with a cone angle of 15° into a cylindrical channel of 0.8 mm diameter ($D_f$) and $L/D_f$ of 10. The fluid monofilaments issued from the cylindrical channel entered an air gap of 25 mm. The fluid monofilaments were taken-up at such rate that a draw ratio of 150 was applied to the fluid monofilaments in the air-gap and then cooled in a water bath kept at about 35° C. and with a water flow rate of about 5 cm/s perpendicular to the monofilaments entering the bath. The $DR_{gel}$ was 1.

The monofilaments subsequently entered an oven at 125° C. In the oven the filaments were further stretched and the decalin evaporated from the monofilaments. The total draw ratio $DR_{overall}$ ($=DR_{fluid}\times\times DR_{gel}\times DR_{solid}$) amounted 12.300.

The properties of the yarn were measured according to the methods described hereinabove and the results are presented in Table 1.

EXAMPLES 2 AND 3

Experiment 1 was repeated, however the chamber before the spin plate was enlarged to the volumes of about 500 cm$^3$ and about 1000 cm$^3$, so that the residence time was 375 and 750 seconds, respectively. The properties of the yarn were measured according to the methods described hereinabove and the results are presented in Table 1.

EXAMPLES 4 AND 5

Experiment 3 was repeated; however a spin plate was used having a spinhole density of 3.5 and 5.5 holes per m$^2$. The properties of the yarn were measured according to the methods described hereinabove and the results are presented in Table 1.

COMPARATIVE EXPERIMENT A

Experiment 1 was repeated without the chamber. Results are presented in Table 1.

COMPARATIVE EXPERIMENT B

Experiment 1 was repeated, however the volume of the chamber was 40 $cm^3$ to yield a residence time of about 30 sec. Results are presented in Table 1.

TABLE 1

| Example | $CV_{intra}$ | $CV_{inter}$ | TS (GPa) |
|---|---|---|---|
| 1 | 19 | 30 | 2.8 |
| 2 | 16 | 24 | 2.8 |
| 3 | 8 | 18 | 2.86 |
| 4 | 7 | 9 | 3.1 |
| 5 | 3 | 4 | 3.2. |
| Comp. Exp. A | 45 | 55 | 2.7 |
| Comp. Exp. B | 35 | 51 | 2.7 |

The invention claimed is:

1. A gel spun, ultrahigh molecular weight polyethylene (UHMWPE) multifilament yarn, wherein the yarn comprises individual monofilaments having a coefficient of variation of their linear density, hereafter $CV_{intra}$, of less than 30%, wherein the $CV_{intra}$ of a monofilament was determined from linear density values corresponding to a number of 20 representative lengths randomly extracted by cutting from said monofilament and using Formula 1

$$CV_{INTRA} = \sqrt{\frac{\sum_{i=1}^{n}(x_i - \bar{x})^2}{n-1}} \times \frac{1}{\bar{x}} \times 100 \quad \text{Formula 1}$$

wherein $x_i$ is the linear density of any one of the representative lengths extracted from the monofilament under investigation and $\bar{x}$ is the averaged linear density over the n=20 measured linear densities of said n=20 representative lengths.

2. A gel spun, ultrahigh molecular weight polyethylene (UHMWPE) multifilament yarn, wherein the yarn has a coefficient of variation in linear density between the monofilaments comprising said yarn, hereafter $CV_{inter}$, of less than 50%, wherein $CV_{inter}$ is determined by using linear density values of a number of 50 representative lengths, wherein each of said lengths corresponds to a different randomly chosen monofilament and is extracted by cutting thereof and using Formula 2

$$CV_{INTER} = \sqrt{\frac{\sum_{i=1}^{n}(x_i - \bar{x})^2}{n-1}} \times \frac{1}{\bar{x}} \times 100 \quad \text{Formula 2}$$

wherein $x_i$ is the linear density of any one of said representative lengths and $\bar{x}$ is the averaged linear density over the n=50 measured linear densities of the n=50 representative lengths corresponding to the randomly chosen monofilaments.

3. The yarn of claim 1 having a tensile strength of at least 1.2 GPa.

4. A process of producing gel spun UHMWPE multifilament yarns according to claim 1 comprising the steps of:

a) feeding to an extruder a slurry containing an UHMWPE in a spinning solvent;

b) converting the slurry in the extruder into a solution of UHMWPE in the spinning solvent;

c) spinning a multifilament yarn by passing the solution of step b) through a spinning plate containing a plurality of spin holes to form the monofilaments comprising said yarn;

d) cooling the obtained monofilaments to form gel monofilaments;

e) removing at least partly the spinning solvent from the gel monofilaments; and f) drawing the monofilaments in at least one drawing step before, during or after removing the spin solvent; wherein a chamber is present before the spinning plate such that no further partitioning of the UHMWPE solution obtained at step b) takes place before said solution being finally partitioned into individual monofilaments in step c) and in which chamber the solution has a residence time $\tau$ at a constant throughput of UHMWPE solution of at least 50 sec.

5. The process of claim 4, wherein the residence time $\tau$ is at least 60 sec.

6. The process of claim 4 wherein the average shear rate to which the UHMWPE solution is subjected inside the chamber is at most 10 $sec^{-1}$.

7. The process of claim 1, wherein a spinning plate is used having at most 20 spin holes per $cm^2$.

8. A rope, net, medical cable or a composite comprising a yarn according to claim 1.

9. A product comprising the yarn according to claim 1, the product chosen from the group consisting of a roundsling;

a fishing net;

a protective textile such as a cut-resistant textile, a scratch-resistant textile and an abrasion-resistant textile, in particular a protective glove;

a sports equipment, in particular a fishing line, a kite line and a yacht line;

an anti-ballistic product, in particular an anti-ballistic vest, an anti-ballistic helmet, an armored vehicle;

an air cargo net and an air freight container.

* * * * *